United States Patent [19]

Cordier et al.

[11] 4,398,701

[45] Aug. 16, 1983

[54] COOLING INSTALLATION FOR A BLAST FURNACE BY MEANS OF STAVE COOLERS

[75] Inventors: Jean Cordier, Dunkerque; Pierre Rollot, Malo-les-Bains, both of France

[73] Assignee: Union Siderurgique du Nord et de l'Est de la France "USINOR", Paris, France

[21] Appl. No.: 285,334

[22] Filed: Jul. 22, 1981

[30] Foreign Application Priority Data

Jul. 22, 1980 [FR] France ..... 80 16105

[51] Int. Cl.[3] ..... C21B 7/10

[52] U.S. Cl. ..... 266/193; 110/180; 122/6 A; 432/238

[58] Field of Search ..... 266/193, 241, 194; 432/238; 122/6 A; 110/180

[56] References Cited

U.S. PATENT DOCUMENTS

| | | | |
|---|---|---|---|
| 2,333,439 | 11/1943 | Peters | 266/193 |
| 4,061,317 | 12/1977 | Andonier et al. | 266/193 |
| 4,250,840 | 2/1981 | Kudinov et al. | 266/193 |

*Primary Examiner*—M. J. Andrews

*Attorney, Agent, or Firm*—Cushman, Darby & Cushman

[57] ABSTRACT

This invention relates to a cooling installation for a blast furnace using stave coolers in which circulates a cooling fluid, these staves being arranged in successive superimposed rings along the internal wall of the shell of the blast furnace and being traversed by internal fluid circulation tubes, the internal tubes of two staves adjacent in a vertical plane being interconnected so as to define a network of vertical fluid circulation lines, wherein this network is connected at each of its extremities to an external circulation and fluid cooling circuit defining a pressurized forced closed circuit in which the cooling fluid is maintained in the liquid phase.

5 Claims, 3 Drawing Figures

34
32
11
10
10a
10b
10c
9a
9b
31
37
36
12a
12b
12c
13
13a
13b
13c
6a
6b
6c
3a
3b
3c
7d
8a
8b
8c
8d
4a
4b
4c
4d
5a
5b
5c
5d
11
10
9
8
7
6
5
4
3
2
1
0
30
29
28
26
25
24
23
27

COOLING INSTALLATION FOR A BLAST FURNACE BY MEANS OF STAVE COOLERS

The instant invention relates to a cooling installation for metallurgical units, the walls of which are subjected to thermic fluxes of elevated temperature and, more particularly, to the cooling of blast furnaces by means of stave coolers.

Modern blast furnaces are increasingly utilized at such velocities and pressure levels that it is important to control the heat fluxes and their transfer, particularly in the zones of the bosh, the body, and the lower, mid, and upper shaft. In particular, in the case of self supporting units, it is indispensable that the shell not be affected by the temperature level and not be subjected to the variations in temperature which could lower the shell's resistance to the strains to which it is subjected.

The heat flux emitted in the different zones of a blast furnace must be collected by a heterogeneous system consisting of a refractory coating, a cooling element, that is, the stave cooler, a shell, such that the cooling element serves the double function of effective cooling of the refractory and screening the passage of the flux towards the shell.

The stave coolers arranged against the internal face of the shell between this latter and the refractory coating fulfill a double function. The staves are made of cast iron elements having a network of tubes in which circulates a cooling fluid which, in the prior art, is water, and which is subjected to a vaporization upon contact with the heat flux which the stave cooler is to be absorb.

However, this type of cooling entails all of the disadvantages inherent in a cooling system in which fluid is vaporized, including elevated pressures, the uncontrollable formation of pockets of vaporization gases at hot points, the difficulty of controlling the flow rate of the circulation, and the more substantial risk of leaks, as well as the corrosive character of the vapor.

The present invention eliminates these disadvantages and provides a cooling installation which is more reliable, is less expensive, as well as functioning in such a manner so as to allow the monitoring and control of the functioning of the blast furnace by the detection of thermic fluxes emitted from the different zones of the blast furnace.

The present invention has, thus, as an object a cooling installation for a blast furnace using stave coolers in which circulates a cooling fluid, these staves being arranged in successive superimposed rings along the internal wall of the shell of the blast furnace, and being traversed by internal circulation tubes for cooling fluid, the internal tubes of two adjacent staves in the vertical plane being interconnected so as to define a network of vertical fluid circulation lines, and wherein this network is connected at each of its extremities to an exterior circulation and fluid cooling circuit thus defining a closed, forced and pressurized circuit in which the cooling fluid is maintained in a liquid phase.

The cooling fluid is normally water which is generally maintained in the liquid state throughout the circuit. One can also utilize as a cooling fluid a special oil resistant up to 300° C.

One obtains, thereby, a global control of the flow rate of water and thus the ability to detect leaks by differential measurement. In addition, one can utilize lower pressures and temperatures for the water, which in turn permits the utilization of apparatus having less stringent technical characteristics and, thus, the cost of the installation is reduced. By knowing the exact flow rate of the liquid as well as the temperatures at different locations, one is able to obtain the quantity of heat evacuated from particular zones of the blast furnace and, thus, a measure of the flux emitted in these different zones. Since the water is maintained in a liquid state, the formation of localized gas pockets, which impede the proper evacuation of calories, is totally avoided and the risks of deterioration by overheating are limited. Finally, it is possible to treat the water in order to give it the property of boiler water with corrosion inhibitors and thus simultaneously avoid the problems of scaling and corrosion.

In addition, it is to be noted that in vaporization systems, it is practically impossible to detect the areas where the vaporization occurs and thus to regulate appropriately the liquid and gas flow rates in the different zones of the installation.

Other characteristics and advantages of the instant invention will appear in the course of the description which follows.

Figure 1:
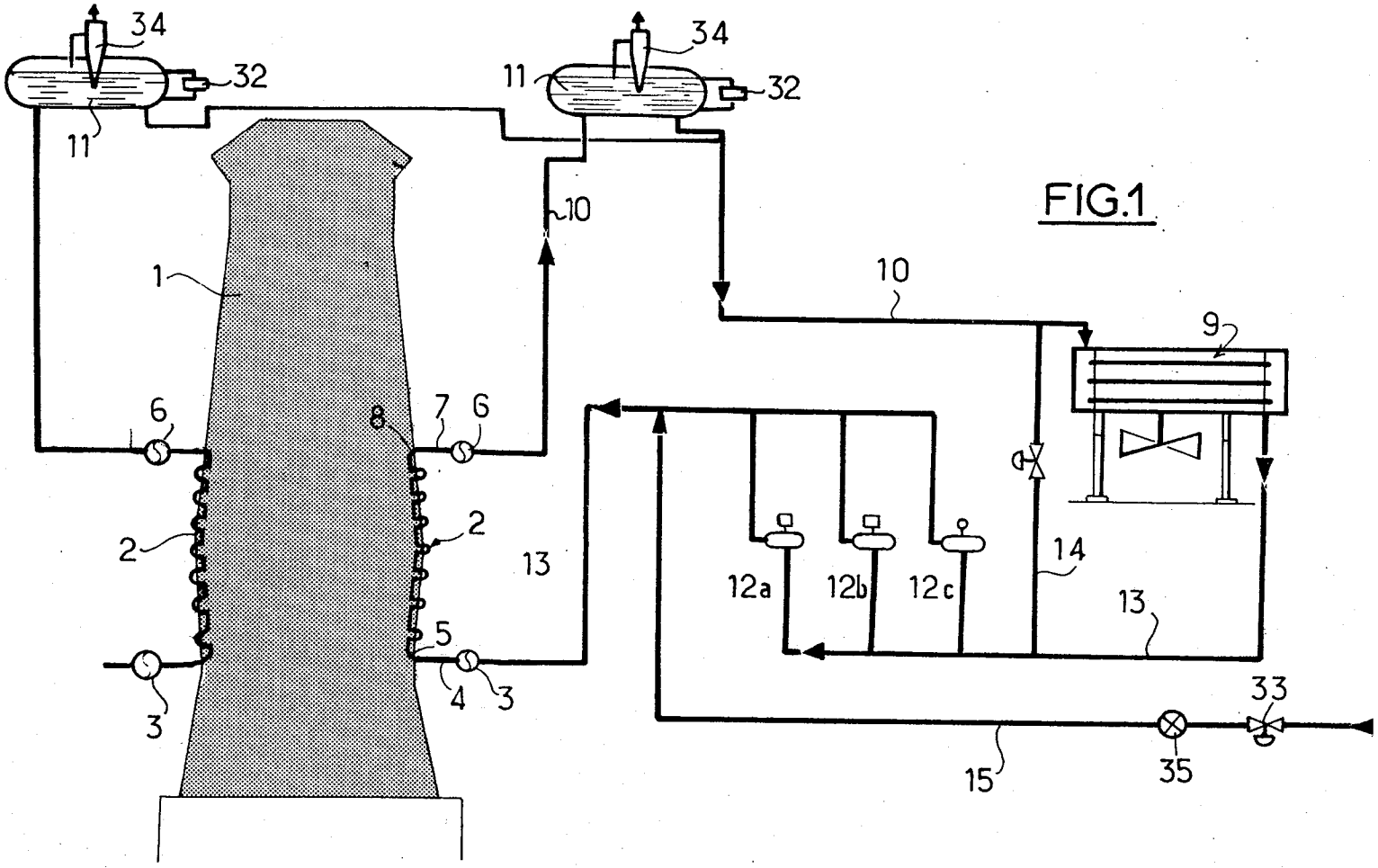
FIG. 1 is a general schematic view of the cooling installation for a blast furnace.

The installation seen in FIG. 1 includes a blast furnace 1, the interior wall of which bearing stave coolers, of which only the internal conductors have been represented, connected to each other and indicated by the general reference 2. The stave coolers include internal tubes which extend to the upper and lower parts of the staves and are connected to the adjacent, immediately superior, stave and to the adjacent, immediately inferior, stave, in a vertical plane, to define a circulation line consisting of the totality of the interconnected internal tubes, seen at general reference 2.

The circular supply conduit 3, which encircles the lower part of the blast furnace, includes a group of individual supply conduits 4 which are connected to the inputs 5 of the circulation lines 2. A circular return conduit 6, which encircles the blast furnace at an upper level, also includes a group of individual return conduits 7, connected to the outputs 8 of the circulation lines. This group of vertical circulation lines constitutes a network arranged along the shell of the blast furnace which is connected, at the lower portion, to the supply conduit 3 and, at the upper portion, to the return conduit 6.

This network of circulation lines is connected at each of its extremities, by means of the supply conduit 3 and the return conduit 6, to an external circuit on which the network is closed.

This circuit includes at least one heat exchanger 9 which is connected to the return conduit 6 by return line 10. One or more expansion vessels 11 are connected, by the return line 10 to the downstream exchanger 9, and to the upstream return conduit 6, and is placed at such a level that the desired pressurization is obtained in the zones of intense thermic flux.

A battery of recycling pumps **12*a*, 12*b*, and 12*c* return the cooling fluid from the exchanger 9 to the supply conduit 3 by supply line 13. This battery of pumps includes two electric pumps 12*a* and 12*b* and one reserve diesel pump 12*c*. A line 14 permits the by-passing of the exchanger 9. A supply line 15 for replenishing cooling fluid is connected to the supply line 13 at a point between the recycling pump battery 12***a*, 12*b*, and 12*c*, and the supply conduit 3.

The expansion vessel includes a level regulator 32 which controls an input valve 33 for replenishing cooling fluid and is placed at the input of the conduit 15. The vessel 11 may also include cyclone 34 for possible degassing.

A counter 35 is included in the line 15 downstream of the valve 33 for detecting possible leaks in the circuit and functions as a first alarm.

In this installation, the cooling fluid is maintained in a liquid state, although, due to the vessel 11, the possibility of an accidental boiling is provided for. The flow rates in the various circulation lines 2 are controlled by means of valves which are not shown and which are located so as to obtain flow rates which are identical in each of the lines. A sufficient flow rate is provided by the battery of recycling pumps.

Figure 2:
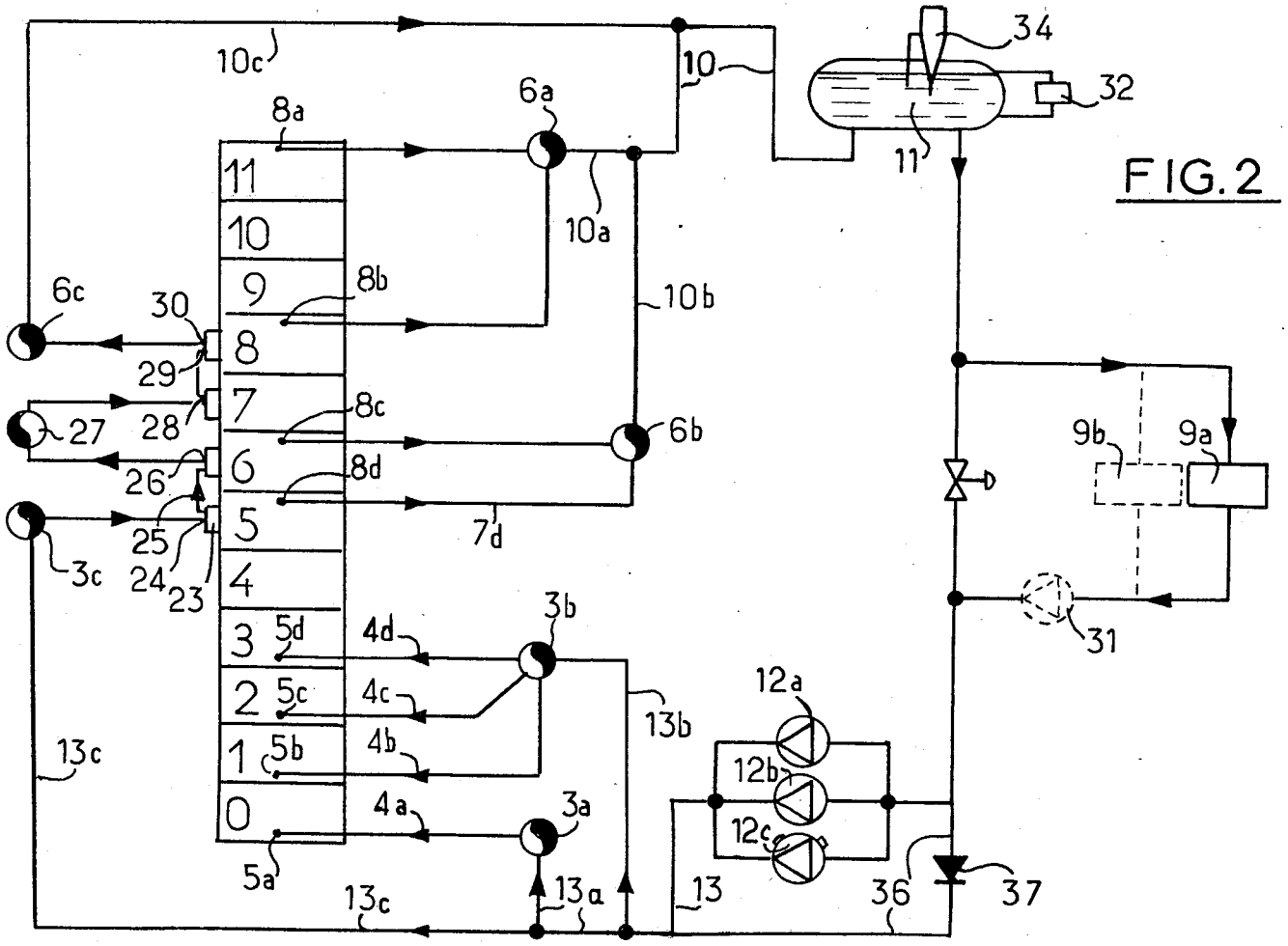
FIG. 2 is also a schematic view of the same installation indicating the different supply levels and the removal of the cooling fluid.

As is seen in FIG. 2, a line 36 permits the by-passing of the battery of recycling pumps 12*a*, 12*b*, and 12*c* and thereby allows for a reserve self-siphoning function. The line 36 also includes a valve 37.

The heat exchanger can be air cooled, as shown, or can be a liquid/liquid heat exchanger and one can include a number of branches in parallel to form a battery.

In the schematic view of FIG. 1, for the purpose of simplification, there has been represented only a single supply conduit and a single return conduit for a cooling fluid circulation line. Further, there has not been shown the majority of the cutoff and regulating valves, as well as their control means, which are well known in the art.

As seen in FIG. 2, the cooling fluid, which shall be considered to be water for purposes of illustration, is introduced at different levels in the same vertical plane corresponding to the various rows of stave coolers which are schematically illustrated by the rectangles numbered 0 to 11. The installation includes two supply conduits 3*a* and 3*b* from which are fed various inputs 5*a*, 5*b*, 5*c*, 5*d* . . . of the internal tubes of the stave coolers defining distinct parallel circulation lines. The installation also includes two return conduits 6*a* and 6*b* which remove the cooling fluid from different levels of the stave coolers. These supply conduits 3*a*, 3*b* and return conduits 6*a*, 6*b* are connected to the external cooling circuit by lines 13*a* and 13*b* connected to the supply line 13 and, for the return conduits, by the lines 10*a* and 10*b* connected to the return line 10.

The individual supply lines 4*a*, 4*b*, 4*c*, 4*d* etc. of the stave coolers connected to the inputs 5*a*,5*b*,5*c* and 5*d* of the internal tubes of the staves, are connected to the staves at different levels, rows 0,1,2, and 3; the number of internal tubes around the circumference of the blast furnace is different in the various zones. As has been mentioned previously, the heat fluxes emitted in a blast furnace vary in the different zones of the blast furnace and it is clear that, as the heat flux increases, it is necessary that the density of the internal cooling tubes at any given circumference also increase. Thus, depending upon the zone in the blast furnace, the number of circulation lines utilized will vary. It is, therefore, necessary to introduce to the inputs 4*a*, 4*b* etc. and to remove from the outputs 8*a*,8*b*,8*c*,8*d*, the amount of cooling fluid corresponding to the various zone levels in order to take account of the density of the circulation lines which are being used at these levels.

Thus, the greater the thermic flux at any zone in the furnace, the greater the number of stave coolers, and the denser the network of internal tubes. Each stave cooler has the same number of internal tubes but the staves will be of various widths depending upon the distance between the internal tubes.

Figure 3:
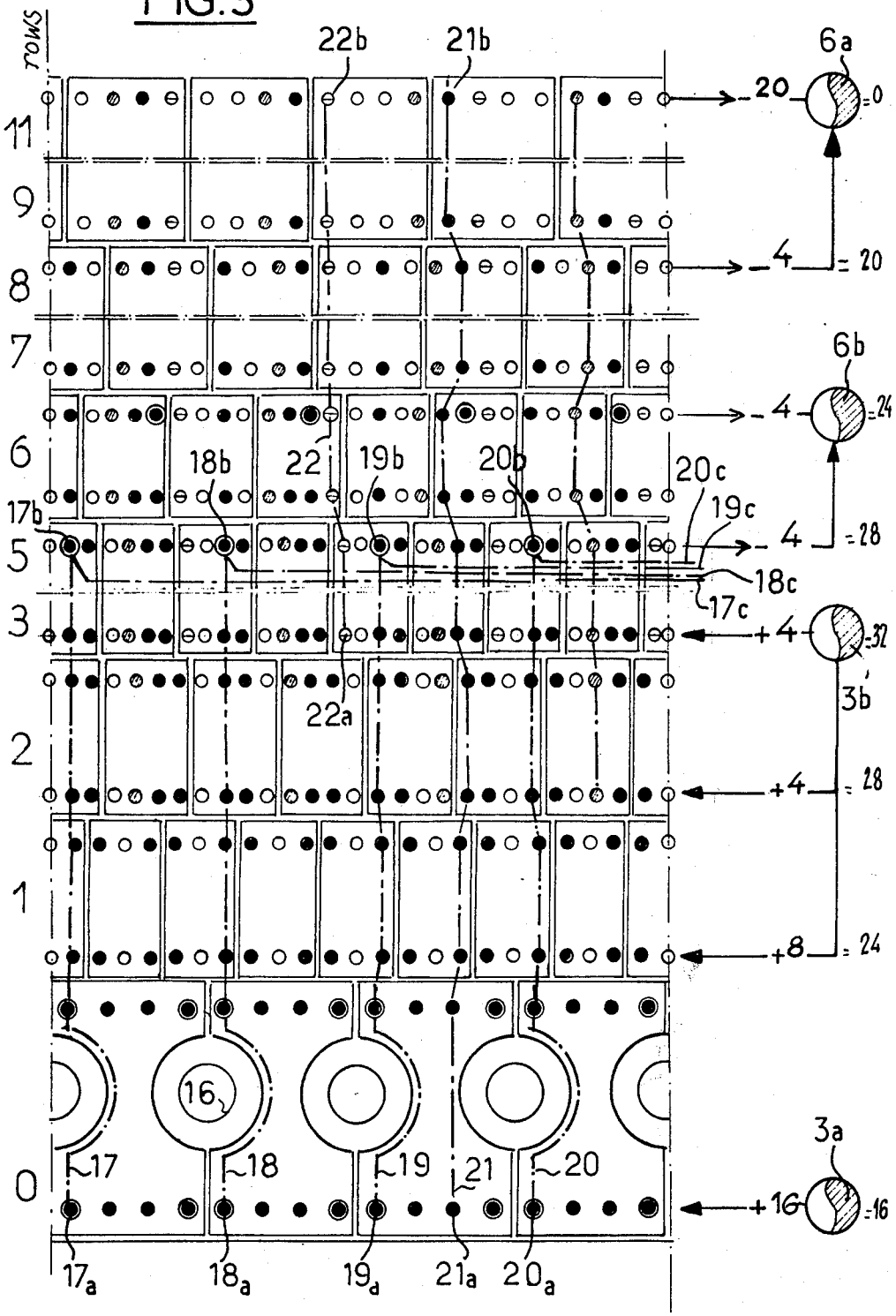
FIG. 3 is a partial view of the network of circulation lines of the cooling fluid for a portion of the total circumference of the blast furnace.

The above discussed characteristics are illustrated in FIG. 3 which shows the stave coolers arranged on the internal surface of a blast furnace on four tuyeres. In this view, the inputs 5 and outputs 8 of the cooling tubes have been represented by black and white circles and circles which are cross-hatched or barred with a horizontal line, to indicate the corresponding points in the same circulation line. This view corresponds exactly to the number of rows of rings of stave coolers illustrated in FIG. 2 with partial eliminations between the rings 3 and 5, since the rings 3 to 5 have identical staves, and similarly, between the rows 7 and 8, and 9 and 11, respectively.

The first row 0 of cooling staves is arranged around the tuyeres 16. From circular supply conduit 3*a*, there extends 16 individual supply tubes which are connected to the inputs of 16 circulation lines for the four lower stave coolers. These 16 circulation lines lead in an approximately vertical plane toward the upper regions of the blast furnace.

In the schematic view of FIG. 3, for the purposes of clarity, for row 0, there is shown only 5 circulation lines 17,18,19,20, and 21 which are fed by individual supply lines (not shown) which lead from the conduit 3*a* to the inputs 17*a*, 18*a*, 19*a*, 20*a*, and 21*a*.

The circulation lines 17,18,19 and 20 lead, respectively, to outputs 17*b*, 18*b*, 19*b* and 20*b* at the level of the staves in row 5 and the cooling fluid is evacuated by means of individual return lines 17*c*, 18*c*, 19*c* and 20*c* to the circular return conduit 6*b*. The lines 17*c*, 18*c*, 19*c* and 20*c* of FIG. 3 correspond to the reference 7*d* schematically illustrated by a single line in FIG. 2. One notes therefore that, at row 5, four lines are removed which is represented by the value −4 corresponding the output line from row 5 to the circular return conduit 6*b*.

The circulation line 21 connecting the input 21*a* to the output 21*b* traverses the totality of the rows of staves along the same vertical plane and outputs at row 11.

At the level of the inputs of the internal tubes of the stave coolers for the rows 1,2 and 3, there is introduced, in addition, from conduit 3*b*, eight supplementary lines for row 1, four additional supplementary lines for row 2, and, finally, four supplementary lines for the row 3, as indicated by the numbers +8, +4 and +4.

There has been indicated, for purposes of illustration, in FIG. 3, a circulation line 22 which is fed at the level of row 3 of the stave coolers by an input 22*a* from circular conduit 3*b* by an individual supply line (not shown) and of which the cooling fluid is removed at the output 22*b* at the level of row 11 to be evacuated by conduit 6*a*.

At the level of the plates of rows 3,4 and 5, one has, therefore, 16+8+4+4=32 circulation lines for four tuyeres, this level corresponding to the maximum density of the circulation lines at which the distance between the internal water circulation tubes is at a minimum. One will note, in addition, that, at this level, the dimensions of the stave coolers, each of which carrying four internal tubes, are at a minimum.

At the level of the outputs of the internal cooling tubes of the staves of row 5, one outputs, by individual return lines, four circulation lines which are connected to the return conduit 6*b*. Similarly, at the level of the output of the internal cooling tubes of the staves of row 6, one outputs four circulation lines which are connected to the return conduit 6*b*. Finally, at the level of the output of the internal tubes of the stave coolers of rows 8 and 11, one outputs, respectively, 4 and 20 circulation lines which are connected to the return conduit 6*a*.

Referring to FIG. 2 it will be noted that the cooling installation depicted includes, besides the principal network of fluid circulation lines which are approximately vertical, an annex network of circulation lines adapted to cool particular parts 23 of the staves called cooling noses. In these cooling noses 23, are placed other internal circulation tubes which are arranged in a horizontal plane. These tubes are in addition to those of the principal network and are similarly connected as in the case of the principal network to their homologues located above in a vertical plane.

Thus a circular supply conduit 3*c* is connected to the supply conduit 13 by conduit 13*c*. The annex supply conduit 3*c* supplies the inputs 24 of the horizontal internal cooling tubes at the level of stave 5. These horizontal internal tubes of the stave 5 are connected to those of the stave cooler of row 6 by a line 25 and the outputs 26 of the horizontal internal cooling tubes of the stave of row 6 are connected to an intermediate conduit 27 of the annex network which effects an equal partition of the cooling fluid. This cooling fluid is conveyed in the horizontal internal tubes of the stave coolers of row 7, then the outputs 28 of these horizontal tubes of the staves of row 7 are connected to the inputs 29 of the horizontal tubes ot the staves of row 8, of which the outputs 30 are connected to an annex return conduit 6*c*. This return conduit 6*c* is connected to the return line 10 by means of line 10*c*.

Each individual circulation line of the principal or annex network can be isolated in the case of a failure in one of these lines, for example, because of a leak. One can measure individually the flow rate in each of these lines as well as the elevations in the temperature of the fluid all along the various levels in a vertical plain.

The battery of exchangers can include, as indicated in FIG. 2, two exchangers 9*a* and 9*b* and a supplementary pump 31 connected in the return circuit of the battery of exchangers 9*a* and 9*b*.

All of the internal tubes of the stave coolers have the same diameter and the velocity of the cooling liquid is maintained at a value between 1.2 and 2.0 meters per second, in order to obtain an appropriate cooling and eliminate any risk of calefaction.

Having now described our invention what we claim as new and desire to secure by Letters Patent is:

1. A cooling installation for a blast furnace including, a plurality of stave coolers arranged in a plurality of successive superimposed rings along the internal wall of the blast furnace, to define a plurality of different horizontal levels of cooling staves, said plurality of successive superimposed rings of stave coolers corresponding to different levels in the blast furnace which are subjected, during normal operation of said blast furnace, to different amounts of heat;

means for variably cooling, during normal operation of said blast furnace, said different levels in correspondance with, and to counteract, said different amounts of heat, the number of levels being variably cooled being greater than two;

said cooling means including a plurality of relatively vertical internal circulation tubes for cooling fluid included in the stave coolers, the number of said tubes in the various said superimposed rings of stave coolers being different, with increased numbers of tubes being located in those rings subjected to relatively greater amounts of heat during normal operation;

said increased number of tubes being provided by the fact that the widths of said stave coolers differ in the various said superimposed rings of stave coolers, with the relatively narrow stave coolers being arranged in the said levels subjected to the relatively higher amounts of heat;

an external circuit means for cooling and maintaining the cooling fluid in a liquid state, including a plurality of supply lines and return lines, with the number of supply lines and return lines for various of said levels varying in accordance with the different numbers of said tubes.

2. The installation according to claim 1, wherein the external circuit includes heat exchange means, pump means and an expansion vessel.

3. The installation according to claim 2, wherein there is included an annex network of cooling fluid circulation lines including a series of horizontally disposed cooling tube means for cooling localized portions of the staves.

4. The installation according to claim 3, wherein the cooling fluid is water.

5. The installation according to claim 3, wherein the cooling fluid is oil.

* * * * *